US005370578A

United States Patent [19]

Yi

[11] Patent Number: 5,370,578

[45] Date of Patent: Dec. 6, 1994

[54] APPARATUS FOR VENTILATING ROOMS PREFERABLY LARGE PREMISES

[75] Inventor: Seong H. Yi, Seoul, Rep. of Korea

[73] Assignee: Sang Su Lim, La Cresenta, Calif. ; a part interest

[21] Appl. No.: 93,174

[22] Filed: Jul. 16, 1993

[30] Foreign Application Priority Data

Jan. 25, 1993 [KR] Rep. of Korea ..... 1993-867[U]

[51] Int. Cl.[5] ..... F24F 13/06; F24F 13/14

[52] U.S. Cl. ..... 454/305; 251/212; 251/250; 454/306; 454/322

[58] Field of Search ..... 251/212, 250; 454/284, 454/292, 305, 306, 322, 333

[56] References Cited

U.S. PATENT DOCUMENTS

| | | | |
|---|---|---|---|
| 2,053,391 | 9/1936 | Caldwell | 454/305 |
| 2,053,403 | 9/1936 | McCormick | 454/316 |
| 2,783,702 | 3/1957 | O'Day | 454/333 |
| 3,070,346 | 12/1962 | Kennedy | 454/333 X |
| 5,275,333 | 1/1994 | Tamblyn | 454/322 X |

FOREIGN PATENT DOCUMENTS

| | | | |
|---|---|---|---|
| 1118819 | 6/1956 | France | 454/333 |
| 2634786 | 2/1978 | Germany | 454/305 |
| 106410 | 3/1943 | Switzerland | 454/333 |
| 908042 | 10/1962 | United Kingdom | 251/212 |
| 543967 | 2/1978 | U.S.S.R. | 251/212 |

*Primary Examiner*—Harold Joyce
*Attorney, Agent, or Firm*—Morgan & Finnegan

[57] ABSTRACT

An apparatus for ventilating spacious public rooms, workshops, industrial halls, underground parking lot and the like spaces, which apparatus comprises a damper having a plurality of shutters attached by a ring to inner surface of tubular body so as to radially move a series of shutters from shut position to opened position. The apparatus further comprises a nozzle having a plurality of guide vanes which occur swirls in jet as well as in injected ventilation air supplied to the rooms. With this arrangement, the apparatus is effective for obtaining a precise adjustment of supply air with minimum air resistance, non-turbulent, and protecting dwelling zones against undesirable thermal air streams or undesirable radiation.

6 Claims, 8 Drawing Sheets

APPARATUS FOR VENTILATING ROOMS PREFERABLY LARGE PREMISES

BACKGROUND OF THE INVENTION

1. Field of the Invention

The present invention relates to an apparatus for ventilating spacious public rooms, workshops, industrial halls, underground parking lot and the like spaces, and more particularly to an apparatus having a damper for adjusting air supply which effectively reduces air resistance, and a nozzle having a plurality of guide vanes which swirl injected ventilation air supplied to the rooms.

2. Description of the Prior Art

As shown in FIGS. 1 to 3, conventional ventilating apparatus of the aforementioned type, for example, is comprised of a damper 10 having shutter plate 12 provided within and across tubular body 11 and operable to rotate for controlling quantity of the air flow passing through the tubular body by operating actuating shaft 14, a end cap 20 formed with extended portion 21,outwardly folded portion 22 and insertion groove 23, a connecting tube 30 having gaskets 31 provided in both ends thereof, a bellows tube 50 connected between the end cap 20 and the connecting tube 30, and a nozzle 40 formed with opening 42 and elongated outlet 41 for injecting air supply from the main duct into the rooms.

The damper 10 is mounted to the tubular branch duct 61 formed in the main duct 60 by inserting one end of the tubular body 11 with gasket 13 into the branch duct 61 and fastening the junction with proper locking means. Further, one end of the bellows 50 is inserted into the groove 23 of the end cap 20, and the end cap 20 is mated with the other end of the tubular body 11 with gasket 13 and fastened along the outwardly folded portion 22. Similarly, the other end of the bellows 50 is coupled with the nozzle 40 which is mated with the connecting tube 30 by insertion of the other end of bellows through the connecting tube 30 and gaskets 31 into the opening 42 of the nozzle 40.

Such an apparatus is preferably connectable in series to a duct installation of ventilating system, as an ejector, which supplies warm or cold air fed from a separate air conditioning means, or supplies ventilation air from a separate blower.

Referring to FIGS. 2 and 3, the shutter plate 12 of the damper 10 is provided with the actuating shaft 14, and is capable of adjusting flow rate in the tubular body 11 by rotating the shaft 14 with appropriate electromechanical actuating means,for example solenoid magnet unit,etc.

The divergent flow of injected air or jet from the nozzle 40 of the apparatus in the spaces has predetermined extent and diffusion angle if the temperature of ventilation air and that of room air have the same value. Otherwise, the divergent flow will vary, particularly in winter or summer. For this reason, there is occurred phenomena of cold draft and air pocket in summer, which caused discomfort to dweller. Further, it is found that the ventilation and/or air conditioning efficiency was lowered in winter since the stagnation zone was formed above dwelling zone by the effect of thermal buoyancy.

Furthermore, as the shutter plate 12 adjusting the air supply is provided perpendicularly across the tubular body 11, and if the shutter plate 12 is controlled and opened to a little amount, it per se suffers considerable supply air pressure and much noise is occurred by turbulent flow around the plate. Therefore, positive pressure of supply fan should be increased such that it compensates for the loss of positive pressure, as well as rotation friction of the actuating shaft 14 supporting the shutter plate 12 should be considerably high so as to stablely keep the controlled rotated position. Thereby, it is difficult to drive the actuating shaft 14 and to exactly adjust air flow when the damper is required to be controlled. In addition, since there was not provided a flow detecting means for measuring quantity of air flow through the damper 10, the adjustment of flow rate was based upon the design or human experience that resulted in undesirable ventilating or air conditioning as well as unnecessary energy consumption.

The present invention is directed to solving the problems of the prior art by providing a precisely adjustable, energy efficient, non-turbulent damper assembly which avoids the noise, control difficulties,and energy waste of the prior art apparatus, and a nozzle which has a unique design to create swirl in jet or in injected ventilation air supplied to the rooms.

SUMMARY OF THE INVENTION

The present invention is predicated upon the development of a novel and unique damper assembly to be incorporated with the conventional ventilating apparatus. Further, a new and unique design for the nozzle discharge is provided which by its guidance of air flow swirl jets injected into the rooms.

Accordingly, it is a principal object of the present invention is to provide a new and improved air damper which is non-turbulent and totally reliable in its operation.

Another object of the present invention is to provide a pressure detecting means incorporated in damper of the ventilating apparatus which can detect pressure at front and rear side of the damper and is adapted to be used in precisely controlling opening degree of the damper as well as the amount of air supply.

A further object of the present invention is to provide a novel and unique air outlet which swirls jet injected into the rooms.

According to preferred embodiment of this invention, there is provided apparatus for ventilating rooms, which comprises: a tubular body connected to branch of the main duct with one end thereof; a damper mounted on the tubular body for controlling air flow through the tubular body; a end cap connected to the other end of the tubular body; a nozzle having a plurality of guide vanes which include a curvature section and a longitudinal section formed along its internal periphery for swirling the air flow passing therethrough; and a bellows tube for connecting the end cap with the nozzle.

In one embodiment, damper having an actuating shaft which is supported by means of a bracket mounted on the surface of the tubular body and a supporting plate traversely disposed at inner surface of the tubular body, this actuating shaft carrying at its inner end a pinion and at its outer end a actuator; a rack slidably supported by the supporting plate and is movable along the longitudinal axis of the tubular body in engagement with the pinion and in response to the rotation of the actuating shaft; a plurality of shutters a part of which are overlapped one another and radially disposed around the rack for narrowing or expanding the cylindrical passageway defined by said shutters; and a pair of connecting rods pivotally mounted between at least two pieces of the shutters and to one side of the rack.

BRIEF DESCRIPTION OF THE DRAWINGS

Further objects and advantages of the invention can be more fully understood from the following detailed description taken in conjunction with the accompanying drawings in which.

DESCRIPTION OF THE PREFERRED EMBODIMENT

Figure 1:
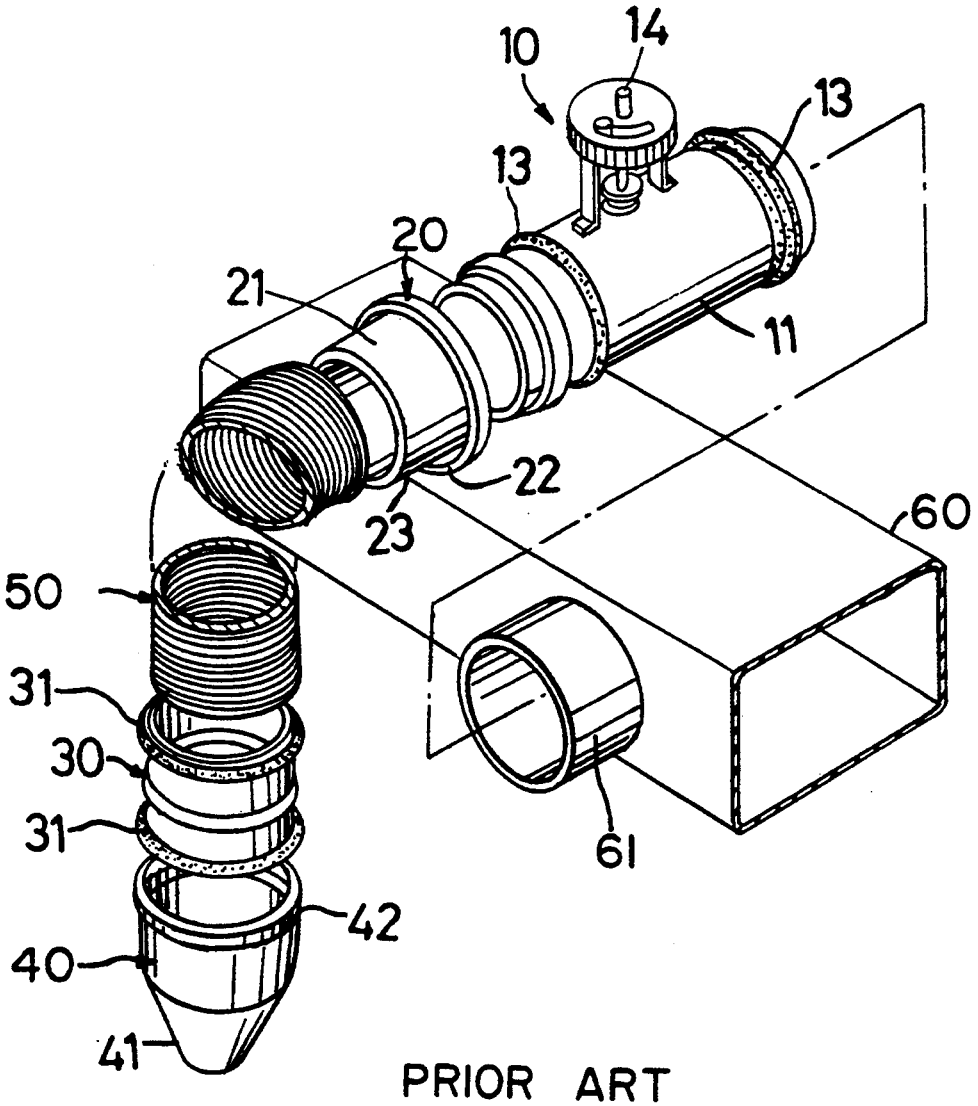
PRIOR ART FIG.1
FIG. 1 is an exploded perspective view of conventional ventilating apparatus.
Figure 3:
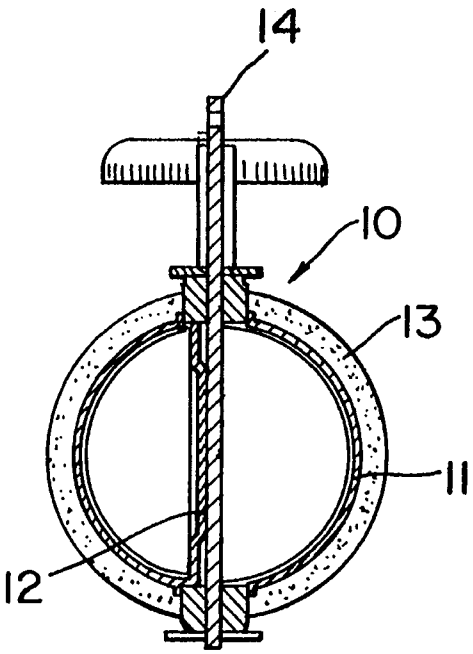
FIG. 3 PRIOR ART
FIG. 3 is a cross-sectional view taken along line X—X of FIG. 2 illustrating shutter plate mounted on the tubular body.
Figure 2:
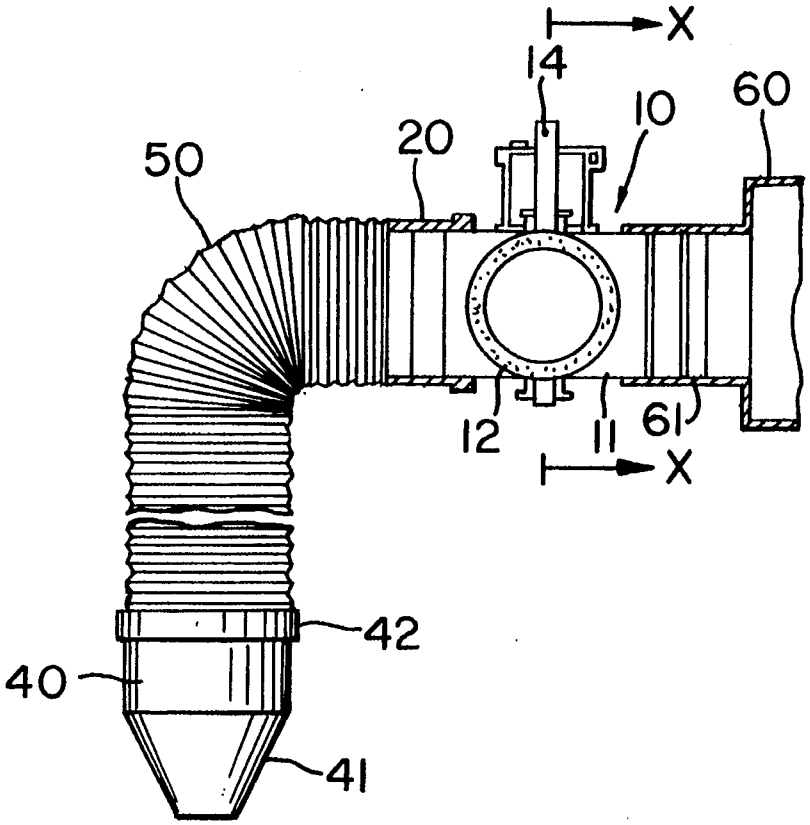
FIG. 2 PRIOR ART
FIG. 2 is a side elevation of FIG. 1 totally incorporated and partially in section of the tubular body and duct including shutter plate of damper.
Figure 4:
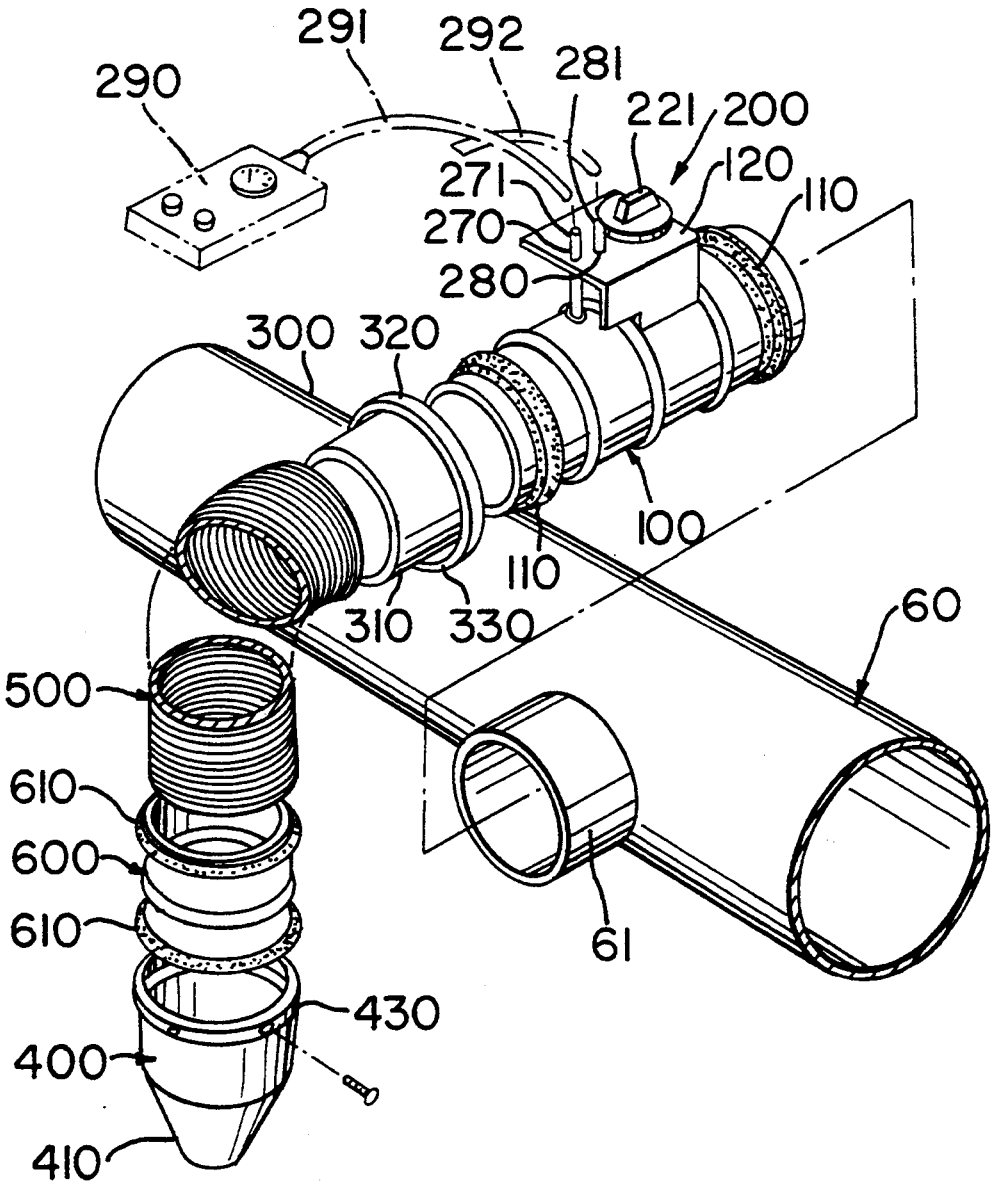
FIG. 4 is an exploded perspective view of a ventilating apparatus in accordance with the present invention.
Figure 5:
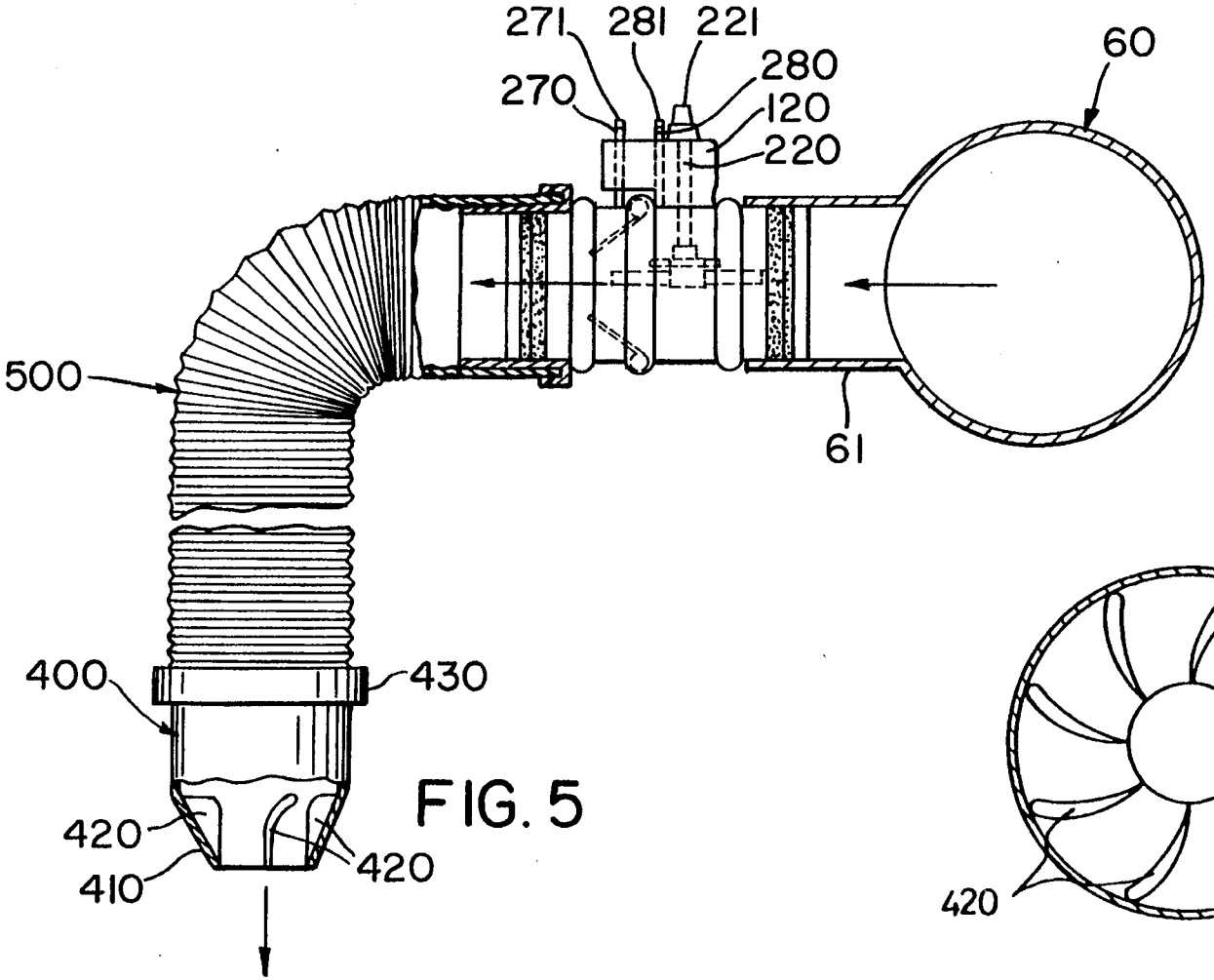
FIG. 5 is a side view of FIG. 4 totally incorporated and partially in section of a tubular body including a damper and a nozzle mounted in accordance with the present invention.

Referring now to FIG. 4 and 5, there is shown a ventilating apparatus including a damper 200 mounted on a tubular body 100 associated with the tubular branch duct 61 of the prior art form. The damper 200 has a unique structural feature in accordance with this invention,which will be described hereinafter with reference to FIGS. 8–10. The tubular body 100 carries two gaskets 110 at both opening ends of the body 100 for air-tight securing as provided in the prior art apparatus. Also, it can be seen from the drawings that an end cap 300 having an extended portion 310, a insertion groove 330, and a outwardly folded portion 320 as well as a bellows tube 500 and a connecting tube 600 having two gaskets 610, for constituting the air flow conduit from the damper location to the desired air outlet site, have the same or similar features as those of the aforementioned conventional ventilating apparatus.

Figure 6:
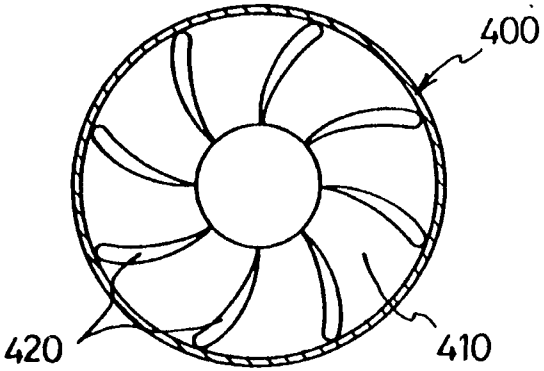
FIG. 6 is an enlarged sectional view of a nozzle taken along line XI—XI of FIG. 5.
Figure 7A:
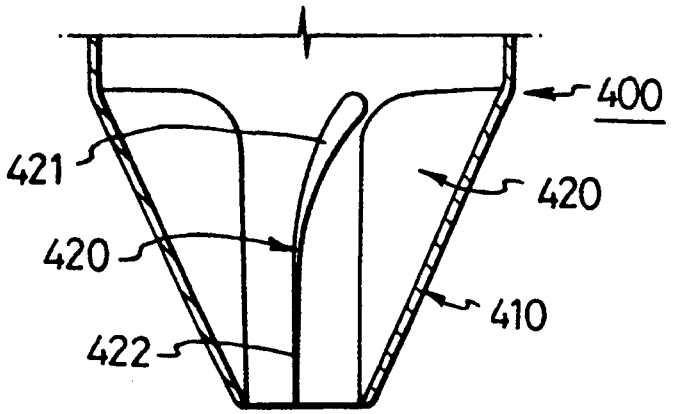
FIG. 7A is a side view partially in section of a nozzle including a plurality of guide vanes of a first preferred embodiment of the present invention.
Figure 7B:
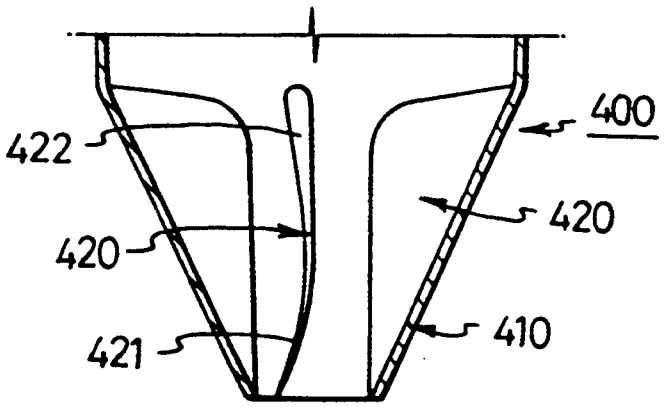
FIG. 7B is a side view similar with FIG. 7A illustrating a plurality of guide vanes of a second embodiment of the present invention.

Referring to FIGS. 6 and 7, there is shown a nozzle 400 which constitutes a part of the present invention and is connected with the bellows tube 500 via connecting tube 600. The nozzle 400 is provided with along its internal periphery a plurality of guide vanes 420 which include a curvature section and a longitudinal section. In the preferred embodiment as shown in FIG. 7A, each guide vane 420 has the curvature section 421 extended from top to center part thereof,and the longitudinal section 422 from center to bottom part thereof. Alternatively, as shown in FIG. 7B, the shape of the guide vane can be formed inversely such that the longitudinal section 422 is disposed from top to center part of the nozzle, and the curvature section 421 from center to bottom part.

Figure 8:
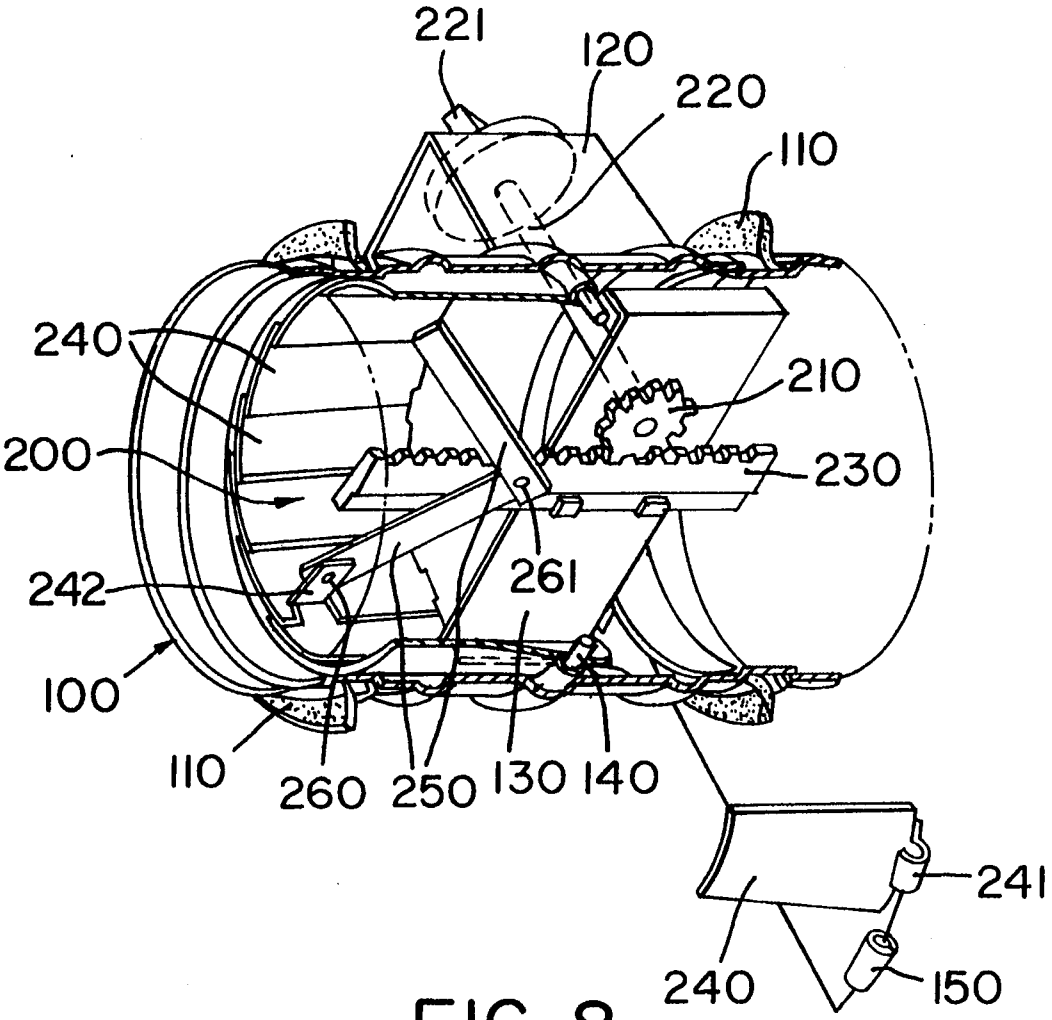
FIG. 8 is a segmentary view of a damper part of a tubular body partially broken away for showing a plurality of shutters and its parts in accordance with the present invention.
Figure 10:
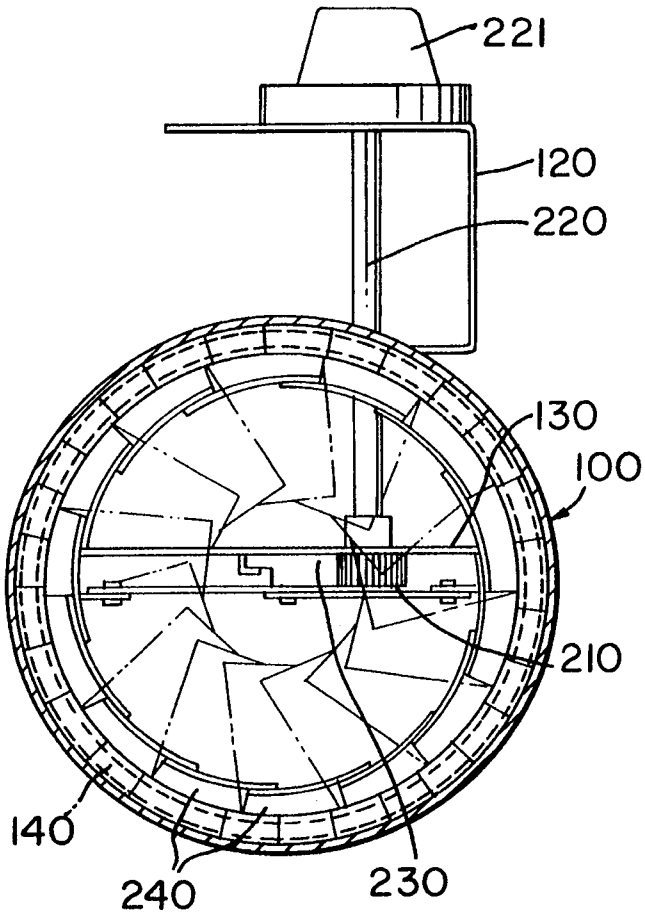
FIG. 10 is a cross-section of a damper mounted on a tubular body illustrating a plurality of shutters which are in series connection and form variable openings.
Figure 9:
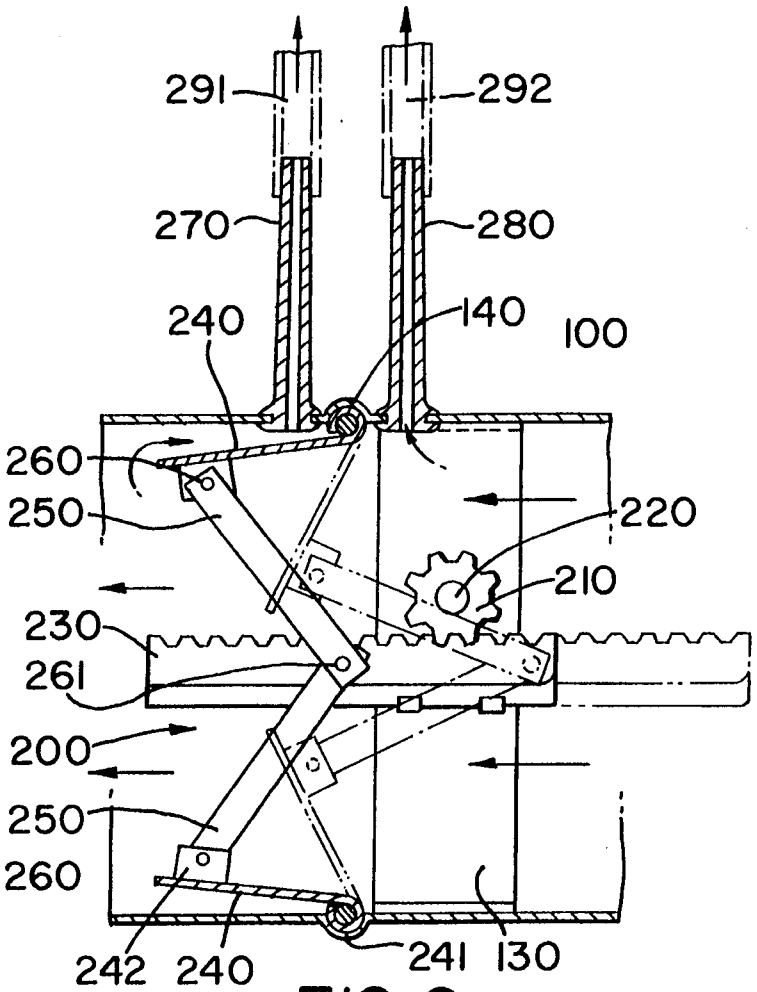
FIG. 9 is a sectional view for explaining operation of a damper assembly shown in FIG. 8.

FIGS. 8 to 10 illustrate a damper assembly embodied in accordance with the present invention. As best seen in FIG. 8, the damper 200 includes a actuating shaft 220 supported by a bracket 120 mounted on the surface of the tubular body 100 and a supporting plate 130 traversely disposed at inner surface of the body 100. The actuating shaft 22 is provided with at its inner end a pinion 210 and at its outer end a actuator 221. The damper 200 comprises a rack 230 which is slidably supported by the supporting plate 130 and movable along the longitudinal axis of the tubular body 200 in engagement with the pinion 210 and in response to the rotation of the actuating shaft 220.

Damper 200 further is provided with a plurality of shutters 240 a part of which are overlapped one another and radially disposed around the rack 230 for narrowing or expanding the cylindrical passageway defined by the shutters 240. Further,there is provided a pair of connecting rods 250 pivotally mounted between at least two pieces of the shutters 240 and to one side of the rack 230 for interlocking the plurality of shutters 240 and the rack 230 by the rotation of the actuating shaft 220.

With the actuator 221 mounted to the outer end of the shaft 220, the shaft is rotatable either manually or automatically by appropriate actuating means to an extent that all of the shutters 240 will move from the full open position to the near shut position. In detail, as shown in FIG. 8, each shutter plate 240 is provided with at one side thereof a hinge portion 241 to which a retainer ring 140 is rotatably fixed interposing a spacers 150 placed two adjacent hinges 241. The retainer ring 140 is attached to the interior circumference of the tubular body 100 at which a receiving groove is formed.

As apparent from FIGS. 9 and 10, a part of longitudinal sides of each shutter plate 240 is overlapped one another along the periphery of inner surface of the tubular body exit. Preferably, opposing two shutter plates comprise a inwardly folded pieces 242 on which the respective connecting rods 250 are pivotally mounted by a axial pins 260. The connecting rods 250 is symmetrical about another pin 261 pivoted on the side of the rack 230. With the interlocking relationship given to the shutters 240 and the rack 230 followed by the pinion 210 of the actuating shaft 220, the shutters 240 will move between fully opened position, as shown in solid lines, and nearly closed position,as shown in virtual lines, pivoting on the retainer ring 241.

Further,referring again to FIG. 9, the damper assembly 200 includes a pair of pressure detecting taps 270,280 of pipe form mounted at one side of tubular body 100 through which their inner ends are passed and the location of the retainer ring 140 is centered to the both taps.

The outer ends of each tap 270,280 is provided with a pair of stoppers 271,281 under normal operating state (See:FIG. 5). When necessary, the stoppers 271,281 can be removed and the pressure detecting taps 270,280 is connected by a extension tubes 291,292 which are directed to a pressure gauge 290 (See FIG. 4) for measuring pressure at the taps.

With the pressure detecting taps 270,280 mounted on the tubular body 100 of the damper assembly, the detected pressure at each tap will be displayed on the gauge 290 and calculated pressure difference can be used in precisely controlling the opening degree of the damper 200 as well as the amount of air supply.

Figure 11B:
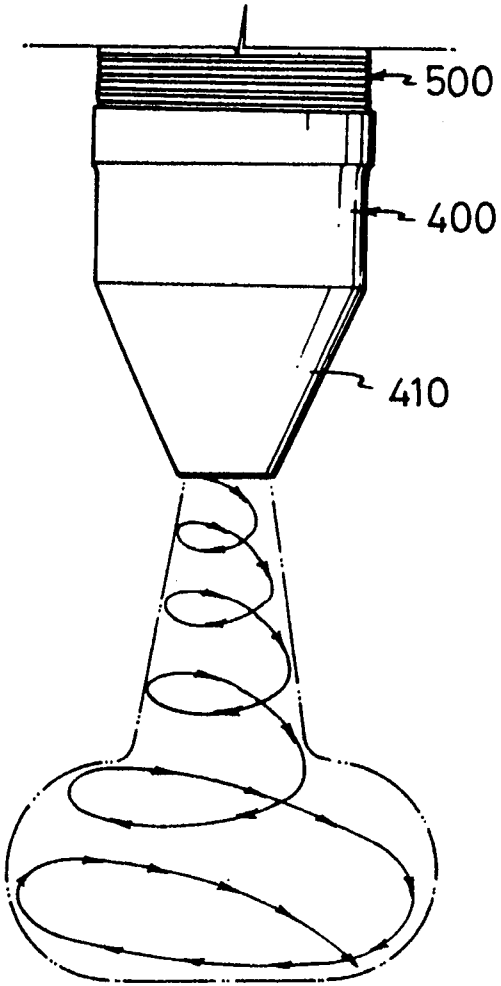
FIG. 11 (A),(B) are schematic views showing distribution patterns of injected air supply fed from nozzle of the conventional apparatus and that of the present invention, respectively.
Figure 11A:
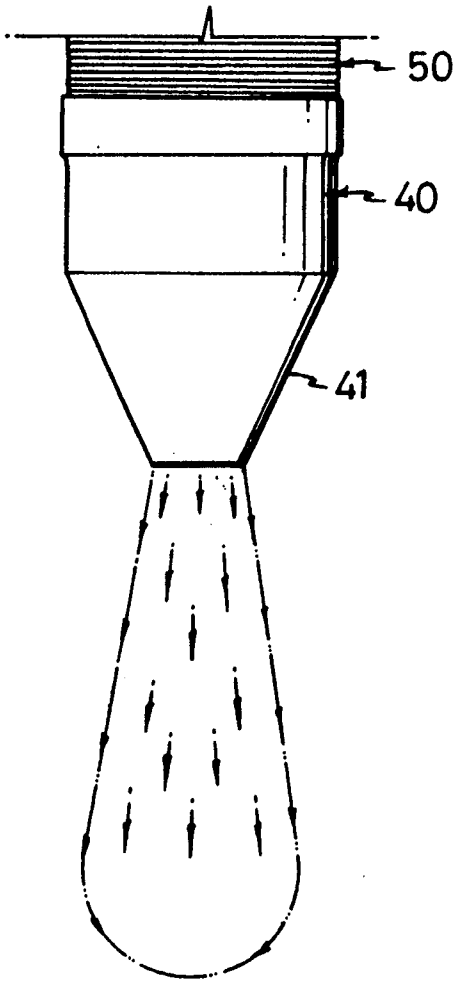

FIG. 11B illustrates an distribution pattern of injected air supply fed from nozzle exit 410, which is occurred by the provision of the guide vanes 420 configured at the internal periphery of the nozzle 400 as discussed in regard to FIG. 7A and 7B. With the swirling forces in the injected air flow, the divergent flow of jet in the rooms will be constantly maintained regardless of the differences between temperature of the ventilation air and that of the room air. Therefore, the phenomena of cold draft and air pocket and the occurrence of stagnation zone can be removed or fairly reduced.

These and other embodiments are within the scope of the invention as described and claimed.

What is claimed is:

1. An apparatus for ventilating rooms comprising:

a tubular body connected to a branch of a main duct at one end thereof;

a damper mounted on said tubular body for controlling air flow through the tubular body, said damper including an actuating shaft which is supported by means of a bracket mounted on the surface of the tubular body and a supporting plate traversely disposed at inner surface of the tubular body, said actuating shaft carrying at its inner end a pinion and at its outer end a actuator, a rack slidably supported by said supporting plate and is movable along the longitudinal axis of the tubular body in engagement with said pinion and in response to the rotation of the actuating shaft, a plurality of shutters a part of which are overlapped one another and radially disposed around said rack for narrowing or expanding the cylindrical passageway defined by said shutters, and a pair of connecting rods pivotally connected at two shutters and to one side of the rack;

a end cap connected to the other end of the tubular body;

a nozzle having a plurality of guide vanes which include a curvature section and a longitudinal section formed along its internal periphery for swirling the air flow passing therethrough; and a bellows tube for connecting said end cap with said nozzle.

2. An apparatus for ventilating rooms as claimed in claim 1, wherein said shutters of the damper each having at one side thereof a hinge portion rotatably fixed to a retainer ring a spacer being interposed between two adjacent hinge portions, said retainer ring being attached to the interior circumference of the tubular body, at which a receiving groove is formed.

3. An apparatus for ventilating rooms as claimed in claims 1 or 2, wherein two opposite shutters comprise an inwardly folded piece to which the respective connecting rods are rotatably fixed by a pins.

4. An apparatus for ventilating rooms as claimed in claim 2, including a pair of pressure detecting taps mounted on one side of the tubular body through which their inner ends are passed, said detecting taps are positioned such that the location of the retainer ring is centered to the both taps.

5. An apparatus for ventilating rooms as claimed in claim 1, wherein said guide vanes of the nozzle each having the curvature section extended from top to center part thereof,and the longitudinal section from center to bottom part thereof.

6. An apparatus for ventilating rooms as claimed in claim 1, wherein said guide vanes of the nozzle each having the longitudinal section extended from top to center part of the nozzle,and the curvature section from center to bottom part thereof.

* * * * *